US009220347B2

(12) United States Patent
Lovley, II et al.

(10) Patent No.: US 9,220,347 B2
(45) Date of Patent: Dec. 29, 2015

(54) COLLAPSIBLE CHAIR WITH INTEGRATED COLLAPSIBLE SHADE COVER

(71) Applicant: BRAVO SPORTS, Santa Fe Springs, CA (US)

(72) Inventors: Jack B. Lovley, II, Lake Forest, CA (US); Joseph C. Klingl, Los Angeles, CA (US)

(73) Assignee: Bravo Sports, Santa Fe Springs, CA (US)

( * ) Notice: Subject to any disclaimer, the term of this patent is extended or adjusted under 35 U.S.C. 154(b) by 0 days.

(21) Appl. No.: 14/199,770

(22) Filed: Mar. 6, 2014

(65) Prior Publication Data

US 2014/0252817 A1 Sep. 11, 2014

Related U.S. Application Data

(60) Provisional application No. 61/774,531, filed on Mar. 7, 2013.

(51) Int. Cl.
*A47C 7/66* (2006.01)
*A47C 4/28* (2006.01)

(52) U.S. Cl.
CPC .. *A47C 7/66* (2013.01); *A47C 4/286* (2013.01)

(58) Field of Classification Search
CPC ..... A47C 7/66
USPC ..... 297/184.1, 184.15
See application file for complete search history.

(56) References Cited

U.S. PATENT DOCUMENTS

| | | | | |
|---|---|---|---|---|
| 3,243,230 | A * | 3/1966 | Otto | 297/184.15 |
| 6,371,553 | B1 * | 4/2002 | Tang | 297/184.1 |
| 6,789,557 | B1 * | 9/2004 | Wahl, Jr. | 135/154 |
| 7,243,990 | B1 * | 7/2007 | Wahl et al. | 297/184.15 |
| 7,431,389 | B2 * | 10/2008 | Reeb et al. | 297/184.15 |
| D612,624 | S | 3/2010 | Lovley et al. | |
| 7,997,291 | B2 * | 8/2011 | Gressette et al. | 135/96 |
| 8,186,755 | B2 | 5/2012 | Lovley | |
| 2013/0069400 | A1 * | 3/2013 | Nikolic | 297/184.15 |
| 2014/0306494 | A1 * | 10/2014 | Frankel et al. | 297/184.15 |

FOREIGN PATENT DOCUMENTS

| | | |
|---|---|---|
| CN | 2012163484 | 4/2009 |
| CN | 102022609 A | 4/2011 |

* cited by examiner

*Primary Examiner* — Peter Brown
(74) *Attorney, Agent, or Firm* — Knobbe Martens Olson & Bear, LLP

(57) ABSTRACT

A collapsible chair with an integrated collapsible shade cover for providing shade to an occupant of the chair. The collapsible shade cover can include cover extensions along a fore and aft direction and a cross member in a direction substantially perpendicular to the cover extensions. The cross member can provide additional structural integrity for the shade cover. The collapsible shade cover can extend beyond the periphery of the cover extensions such that additional shading is provided to the occupant. The shade cover can extend beyond the periphery of the cover extensions via use of the cross member.

15 Claims, 16 Drawing Sheets

COLLAPSIBLE CHAIR WITH INTEGRATED COLLAPSIBLE SHADE COVER

INCORPORATION BY REFERENCE TO PRIORITY APPLICATION

The present application claims priority to U.S. Provisional Application No. 61/774,531 filed Mar. 7, 2013, entitled COLLAPSIBLE CHAIR WITH INTEGRATED COLLAPSIBLE SHADE COVER, the entire contents of which are hereby expressly incorporated by reference herein and made a part of the present disclosure.

BACKGROUND OF THE INVENTION

1. Field of the Invention

The present invention relates to collapsible chairs and, in particular, collapsible chairs having a collapsible shade cover.

2. Description of the Related Art

Collapsible chairs are commonly used to provide portable seating for outdoor activities such as camping, fishing, sporting events, and more. Such collapsible chairs typically comprise a foldable chair frame constructed to support a fabric seat and back support. The foldable chair frame typically comprises a plurality of legs configured to be easily collapsed for storage and transport and deployed for seating use.

While conventional collapsible chairs are useful for a variety of purposes, such as providing portable seating, they leave room for improvement with respect to providing a shaded seating environment for the user. Some conventional collapsible chairs incorporate a collapsible shade cover in order to reduce the user's exposure to the sun or other outdoor elements including precipitation. One example of collapsible chair with integrated collapsible shade cover is included in U.S. Pat. No. 8,186,755 to Jack Lovley, herein incorporated by reference in its entirety. Although the chair of the '755 patent is well-suited for its intended purpose, there is a need or desire in the market for continually improved chair designs.

SUMMARY OF THE INVENTION

The systems, methods and devices described herein have innovative aspects, no single one of which is indispensable or solely responsible for their desirable attributes. Without limiting the scope of the claims, some of the advantageous features will now be summarized.

One aspect of the present invention is the realization that a conventional collapsible chair with a collapsible shade cover provides a limited amount of shade to the user. Another aspect of the present invention is the realization that a conventional collapsible chair with a collapsible shade cover is vulnerable to misalignment and twisting when exposed to the outdoor elements. Thus there exists a need for an improved collapsible chair with integrated collapsible shade cover design.

One non-limiting embodiment of the present invention includes collapsible chair with an integrated collapsible shade cover comprising a chair frame, a seat, a back rest, a pair of cover legs, a pair of hinge locks, a pair of cover extensions, a pair of cover supports, a pair of slide locks, and a cross member. The cross member is configured to support portions of the shade cover which protrude outward from the cover extensions, providing additional shade to the user of the chair as well as increasing the structural integrity and stiffness of the collapsible shade cover.

In some configurations, a collapsible chair with an integrated collapsible shade cover can include a chair having a chair frame, a seat, and a back rest; a collapsible shade cover coupled to the chair frame, the collapsible shade cover having a pair of vertical supports, wherein the vertical supports are pivotally coupled to the chair frame; a pair of cover extensions pivotally coupled to the pair of cover legs and extending in a fore-aft direction of the chair; a shade cover affixed to the cover extensions; a cross member having first and second end portions that support respective first and second portions of the shade cover which protrude outward from the cover extensions, wherein the cross member is substantially perpendicular to the cover extensions in an extended state.

In some configurations, the shade cover can extend outwardly from the cover extensions by about 25% of the length of the cover extensions. In some configurations, the shade cover can extend outwardly from the cover extensions by about 30% of the length of the cover extensions. In some configurations, the shade cover can have an area about 35% more than an area defined between the cover extensions. In some configurations, the shade cover can have an area about 46% more than an area defined between the cover extensions. In some configurations, the cross member can extend outwardly from the cover extensions by about 25% of the length of the cover extensions. In some configurations, the cross member can extend outwardly from the cover extensions by about 30% of the length of the cover extensions.

In some configurations, a collapsible chair with integrated collapsible shade cover can include: a collapsible chair having a chair frame, a seat, and a back rest; a collapsible shade cover coupled to the chair frame, the collapsible shade cover having a pair of cover legs, wherein the cover legs are pivotally coupled to the chair frame; a pair of hinge locks configured to retain the pair of cover legs in a deployed position when the pair of hinge locks is in a locked position; a pair of cover extensions pivotally coupled to the pair of cover legs; a pair of cover supports pivotally coupled to the pair of cover extensions; a pair of slide locks, wherein the pair of cover supports are pivotally coupled to the pair of slide locks and wherein the slide locks are slideably coupled to the pair of cover legs; wherein the slide locks are configured to lock in various positions along the pair of cover legs; a shade cover affixed to the cover extensions; a cross member configured to support portions of the shade cover which protrude outward from the cover extensions, wherein the cross member is substantially perpendicular to the cover extensions in an extended state, wherein the cross member is configured to lock into the extended state, wherein the cross member is configured to bend approximate its center and collapse for storage or transport, and wherein the cross member includes a first cross member leg and a second cross member leg; a cross member coupling configured to pivotally couple the first cross member leg to the second cross member leg, wherein the cross member coupling includes a first receiving portion configured to receive the first cross member leg, and a second receiving portion configured to receive the second cross member leg, wherein the second receiving portion is pivotally coupled to the first receiving portion, wherein the cross member coupling is configured to prevent the first cross member leg and the second cross member leg from rotating substantially past a point at which the first cross member leg and the second cross member leg are aligned.\ In some configurations, the shade cover can extend outwardly from the cover extensions by about 25% of the length of the cover extensions. In some configurations, the shade cover can extend outwardly from the cover extensions by about 30% of the length of the cover extensions. In some configurations, the shade cover can have an area about 35% more than an area defined between the cover extensions. In some configurations, the shade cover can have an area about 46% more than an area defined between the cover extensions. In some configurations, the cross member can extend outwardly from the cover extensions by about 25% of the length of the cover extensions. In some configurations, the cross member can extend outwardly from the cover extensions by about 30% of the length of the cover extensions.

BRIEF DESCRIPTION OF THE DRAWINGS

Throughout the drawings, reference numbers can be reused to indicate general correspondence between reference elements. The drawings are provided to illustrate example embodiments described herein and are not intended to limit the scope of the disclosure.

DETAILED DESCRIPTION OF THE PREFERRED EMBODIMENTS

Figure 1:
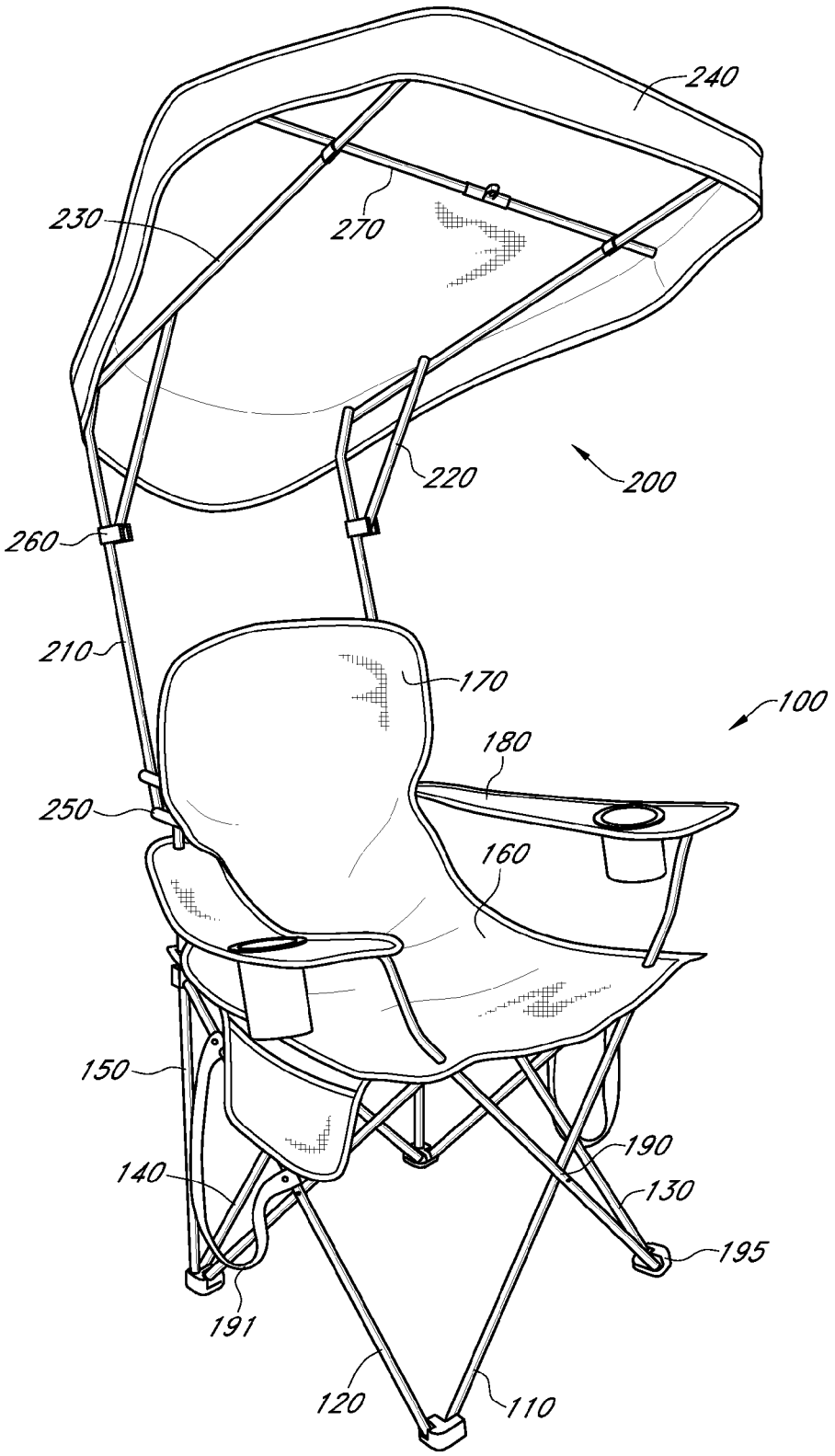
FIG. 1 illustrates a perspective view of one embodiment of a collapsible chair with integrated collapsible shade cover in a deployed state.

FIG. 1 illustrates a perspective view of one embodiment of a collapsible chair with an integrated collapsible shade cover in a deployed state. In one embodiment, the collapsible chair with integrated collapsible shade cover comprises a collapsible chair 100 and a collapsible shade cover 200. In one embodiment the collapsible chair 100 comprises a collapsible chair frame constructed to support a fabric seat 160 and back rest 170. The chair frame comprises a plurality of legs configured to be easily collapsed for storage and transport and deployed for seating use.

In one embodiment, the plurality of legs comprise a front pair of cross legs 110, a right side pair of cross legs 120, a left side pair of cross legs 130, a rear pair of cross legs 140, and a pair of vertical legs 150. The cross legs of each pair of cross legs are pivotally coupled approximately midway between the ends of each cross leg. Each cross leg has a base portion and a top portion. The base portion is the portion of the cross leg closest to the ground and the top portion is the portion of the cross leg furthest from the ground. The front pair of cross legs 110 is pivotally coupled to the left side pair of cross legs 130 and the right side pair of cross legs 120 near the base portion and near the top portion of the front cross legs 110. The rear pair of cross legs 140 is pivotally coupled to the left side pair of cross legs 130 and the right side pair of cross legs 120 near the base portion and near the top portion of the rear cross legs 140. The pair of vertical legs 150 are pivotally coupled to the rear pair of cross legs 140 and each side pair of cross legs 120, 130 at the base portion of the pair of vertical legs 150. The pair of vertical legs 150 is both pivotally and slideably coupled to the rear pair of cross legs 140 and each side pair of cross legs 120, 130 between the top portion and the bottom portion of the pair of vertical cross legs 150. In one embodiment, this configuration allows the top portion of the plurality of cross legs to move vertically relative to the pair of vertical cross legs 150 during collapse and deployment of the collapsible chair 100.

In one embodiment, legs are pivotally coupled to one another at a pivot point 190. In one embodiment, a pivot point 190 may comprise a fastener which passes through each leg, and each leg may rotate about the longitudinal axis of the fastener. In another embodiment, legs are pivotally coupled via an intermediary member 195, such as a bracket, which each leg may be pivotally coupled to. In one embodiment, each leg is pivotally coupled to the intermediary member 195 through the use of a fastener. One advantage to the use of an intermediary member 195 is allowing each leg to pivot about a different axis, allowing the collapsible chair 100 to collapse in multiple directions. In one embodiment, in addition to a fastener, other forms of pivoting securing means may be used to constrain one leg to another yet allow them to pivot relative to one another around at least one axis. These means could include, for example, a fastener, a pin, a rivet, an axle, etc.

In one embodiment, the seat 160 and back rest 170 are affixed to the chair frame so that the seat 160 and back rest 170 form a chair when the collapsible chair 100 is in a deployed position. In one embodiment, the collapsible chair 100 further comprises arm rests 180 supported at one end by the pair of vertical legs 150 and at one end by the pair of front cross legs 110. In one embodiment, the arm rests may further comprise a pocket or recess to hold a beverage or other small item.

In one embodiment, the collapsible shade cover 200 is integrated into the collapsible chair 100 to provide shade for the user sitting in the collapsible chair 100. The collapsible shade cover 200 comprises a cover frame which is constructed to support a shade cover 240. The cover frame comprises a pair of hinge locks 250 which are affixed to the pair of vertical legs 150 of the collapsible chair 100. The cover frame further comprises a pair of cover legs 210 which comprise a chair engaging portion and a cover engaging portion. The chair engaging portion of the pair of cover legs 210 are pivotally coupled to the pair of hinge locks 250. The cover frame further comprises a pair of cover extensions 230. Each cover extension 230 comprises a rear portion and a front portion. The rear portions of the extensions 230 are pivotally coupled to the cover engaging portions of the cover legs 210. The cover frame further comprises a pair of cover supports 220 which support the cover extensions 230. At one end, the cover supports are pivotally coupled to the cover extensions 230 at a location between the rear portion and the front portion of the cover extensions. At the opposite end, the cover supports 220 are pivotally coupled to the slide locks 250 which are slideably coupled to the cover legs 210. In one embodiment, this configuration of the cover frame allows the collapsible shade cover 200 to rotate about an axis substantially perpendicular to each cover extension 230 as illustrated in FIGS. 2A and 2B.

Figure 2A:
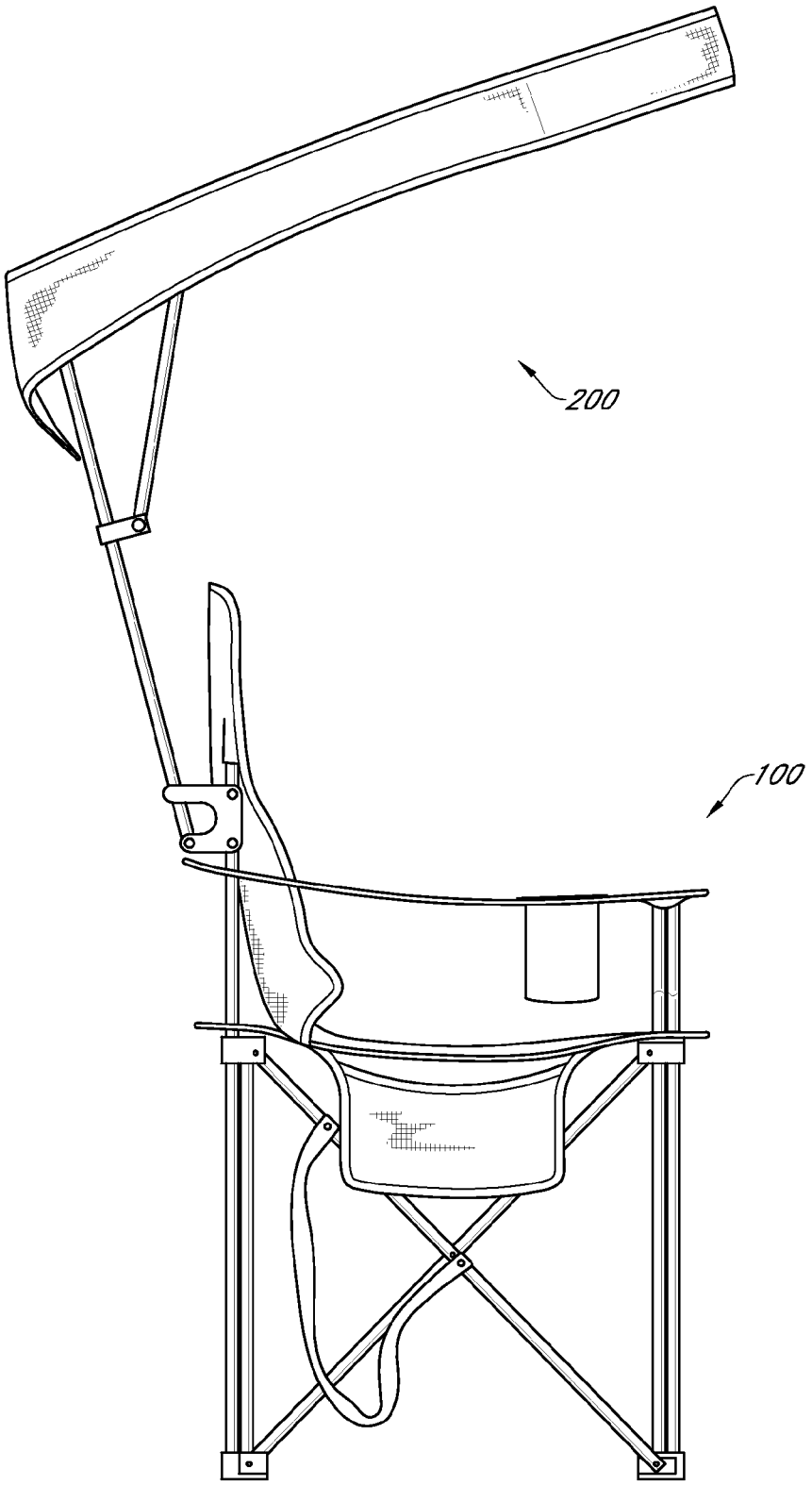
FIG. 2A illustrates a side view of the collapsible chair with integrated collapsible shade cover of FIG. 1 with the collapsible shade cover adjusted to a raised position.
Figure 2B:
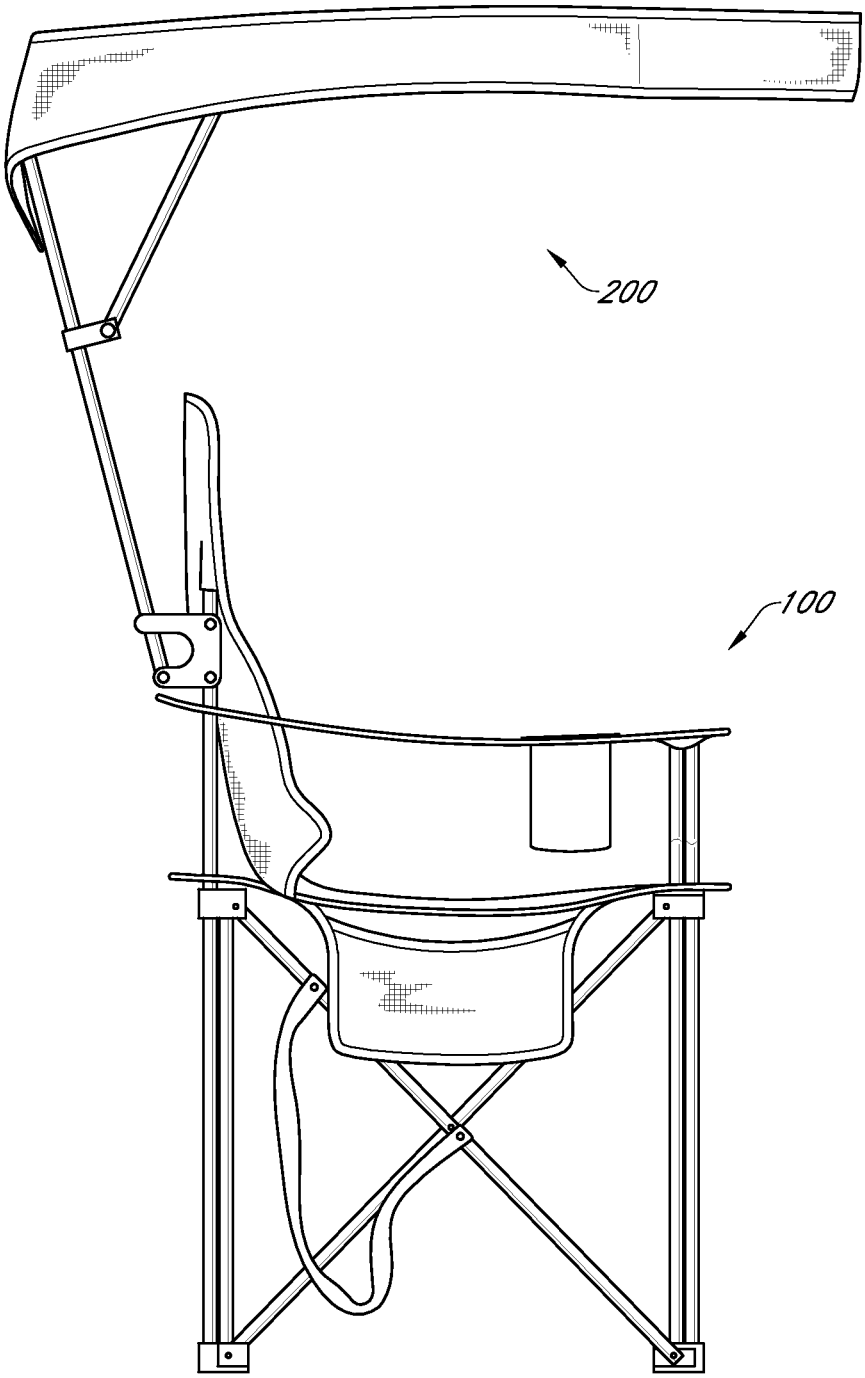
FIG. 2B illustrates a side view of the collapsible chair with integrated collapsible shade cover of FIG. 1 with the collapsible shade cover adjusted to a lowered position.

FIG. 2A illustrates a side view of the collapsible chair with integrated collapsible shade cover of FIG. 1 with the collapsible shade cover 200 adjusted to a raised position. FIG. 2B illustrates a side view of the collapsible chair with integrated collapsible shade cover of FIG. 1 with the collapsible shade cover 200 adjusted to a lowered position. In one embodiment, the angle of the collapsible shade cover 200 relative to the collapsible chair 100 is adjustable. The collapsible shade cover 200 can be rotated upwards to a raised position as illustrated in FIG. 2A and the collapsible shade cover 200 can be rotated downwards as illustrated in FIG. 2B. By adjusting the position of the collapsible shade cover 200, the user can adjust the level and location of the shade provided by the collapsible shade cover 200. In one embodiment, each cover extension 230 and thus each side of the collapsible shade cover 200 can be rotated upwards and downwards independently of the other, allowing the user to adjust the angle of the collapsible shade cover 200 about an axis substantially parallel to each cover extension 230 (not illustrated). In one embodiment, the user can rotate the cover 240 both about an axis substantially perpendicular to each cover extension 230 as well as an axis substantially parallel to each cover extension 230, giving the user flexibility in manipulation of the collapsible shade cover 200 and the location of the shade provided by the collapsible shade cover 200.

Figure 2C:
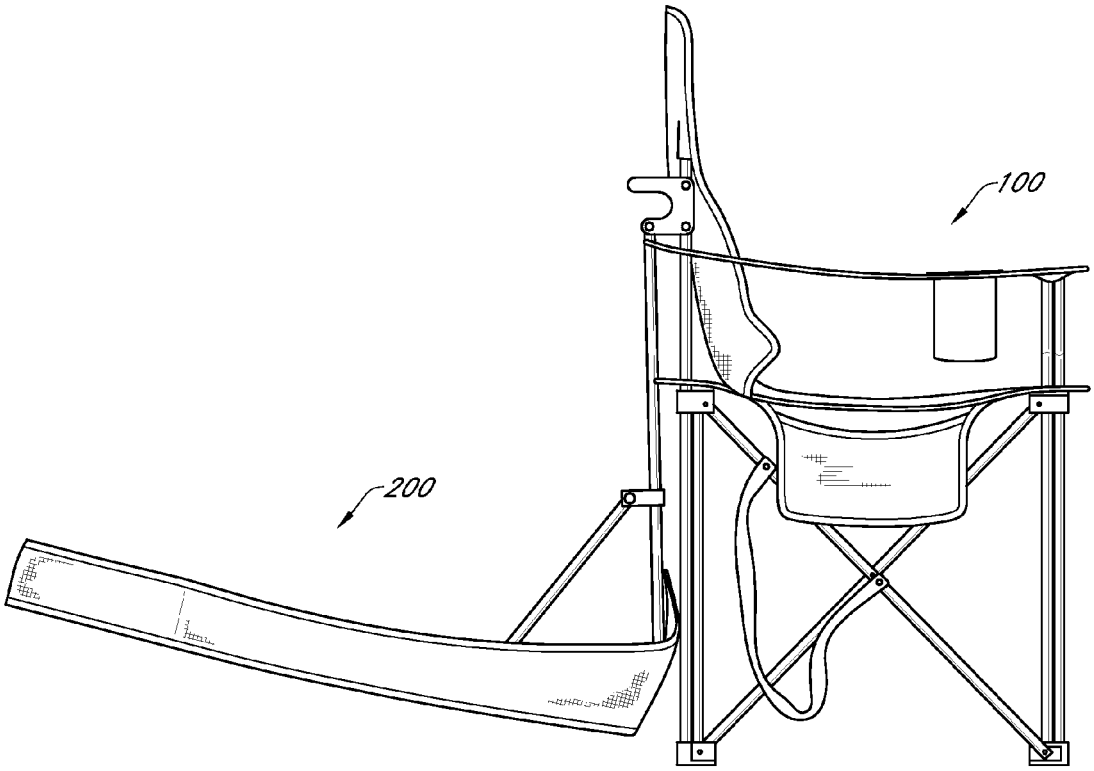
FIG. 2C illustrates a side view of the collapsible chair with integrated collapsible shade cover of FIG. 1 with the collapsible shade cover in a partially collapsed state.
Figure 2D:
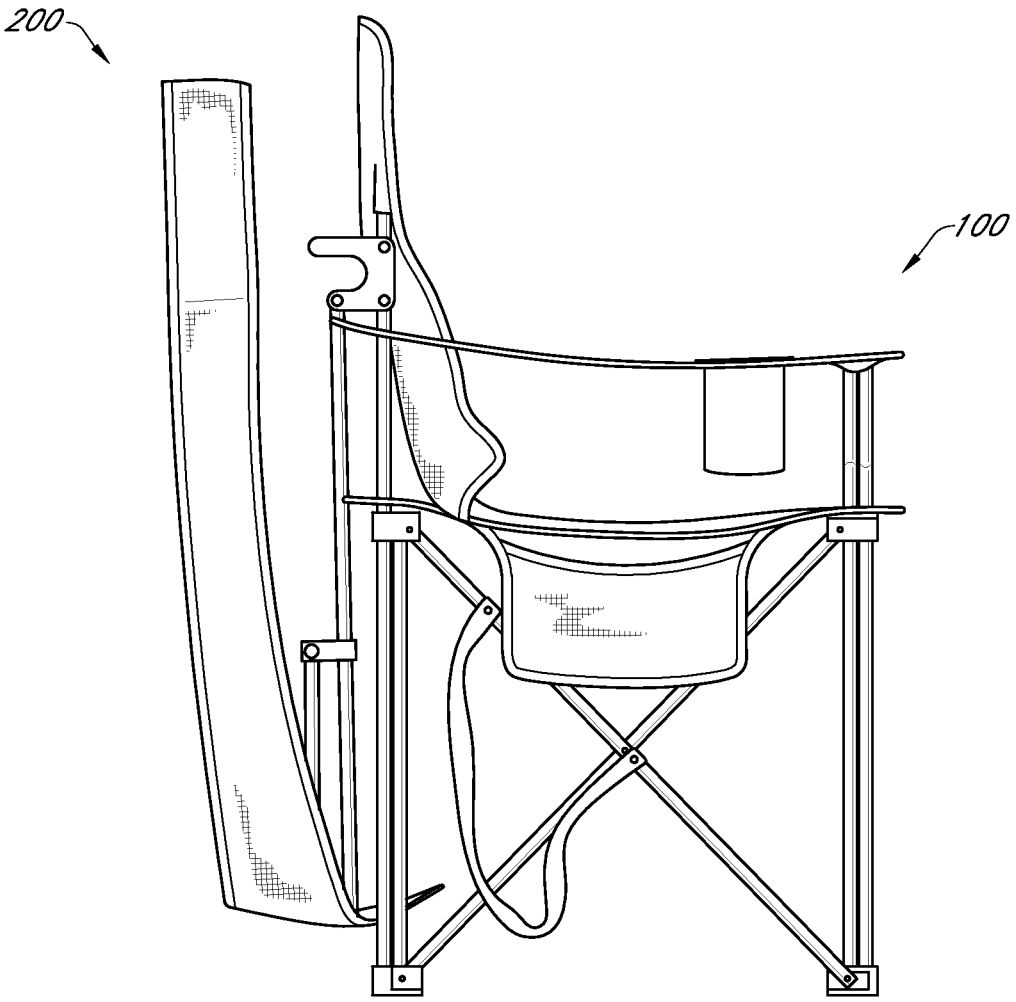
FIG. 2D illustrates a side view of the collapsible chair with integrated collapsible shade cover of FIG. 1 with the collapsible shade cover in a fully collapsed state.

FIG. 2C illustrates a side view of the collapsible chair with integrated collapsible shade cover of FIG. 1 with the collapsible shade cover 200 in a partially collapsed state. FIG. 2D illustrates a side view of the collapsible chair with integrated collapsible shade cover of FIG. 1 with the collapsible shade cover 200 in a fully collapsed state. In one embodiment the collapsible cover 200 shade can collapse from its deployed state as illustrated in FIG. 2B to a partially collapsed state as illustrated in FIG. 2C and then to a fully collapsed state as illustrated in FIG. 2D. In order for the collapsible cover 200 shelter to go from a deployed state to a partially collapsed state, the pair of cover legs 210, and with them, the rest of the collapsible shade cover 200, rotate about the pivotal connection between the cover legs 210 and the hinge locks 250. In order for the collapsible shade cover 200 to go from a partially deployed state to fully collapsed state, the cover extensions 230 rotate about the pivotal connection between the cover extensions 230 and the cover legs 210, and the slide locks 260 slide along the cover legs 210, allowing the cover extensions 230 and the cover 240 to rotate towards the back rest 170 of the collapsible chair 100. The steps above do not necessarily need to be performed in the described order. In one embodiment, the cover extensions 230 may be rotated prior to rotating the cover legs 210. In one embodiment, the collapsing may involve an additional step of collapsing the cross member 270 as discussed below. The deployment of the collapsible shade cover 200 may be achieved by performing the steps described above in reverse order.

Figure 2E:
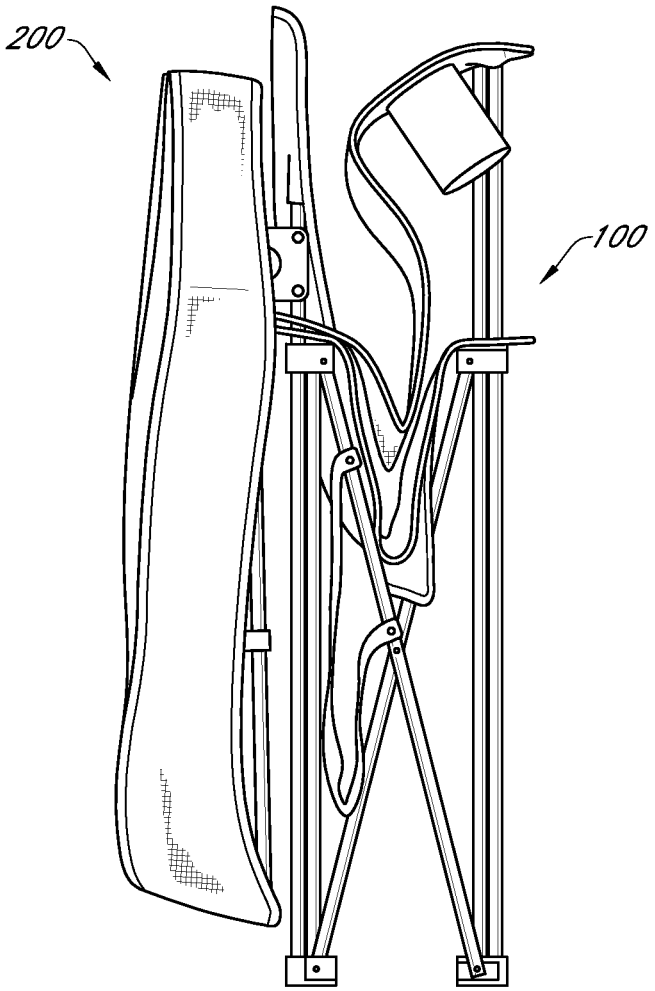
FIG. 2E illustrates a side view of the collapsible chair with integrated collapsible shade cover of FIG. 1 in a fully collapsed state.

FIG. 2E illustrates a side view of the collapsible chair with integrated collapsible shade cover of FIG. 1 in a fully collapsed state. Once the collapse shade cover 200 is collapsed to a collapsed state, the collapsible chair 100 may then be collapsed, as illustrated in FIG. 2E, so that the entire collapsible chair with integrated collapsible shade cover assembly is in a fully collapsed state. Collapse of the collapsible chair 100 may be achieved by forcing the corners of the collapsible chair 100 inwards towards its center, forcing the legs to rotate about their pivot points and come together into a collapsed state. Once the collapsible chair with integrated collapsible shade cover is in a fully collapsed state, it may be transported, stored, or fitted into a bag to be transported, or stored.

Figure 3A:
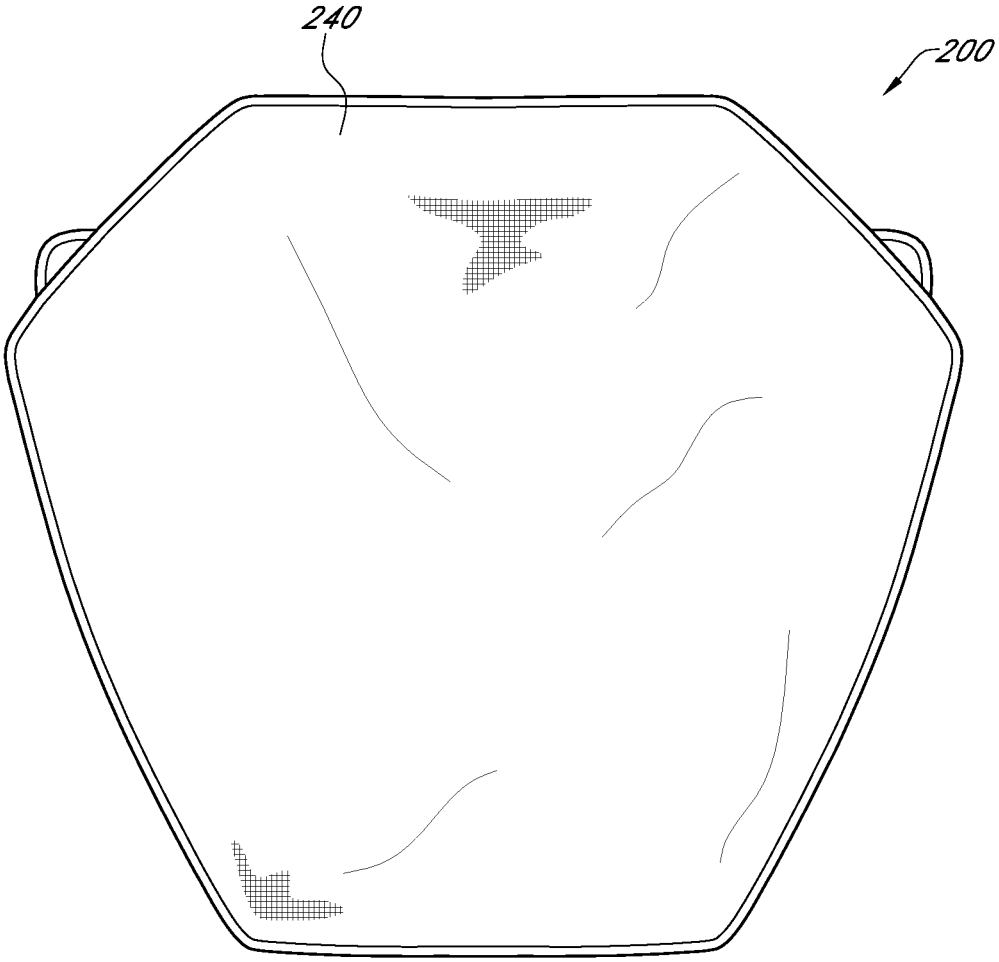
FIG. 3A illustrates a top view of one embodiment of a collapsible shade cover in an extended position.
Figure 3B:
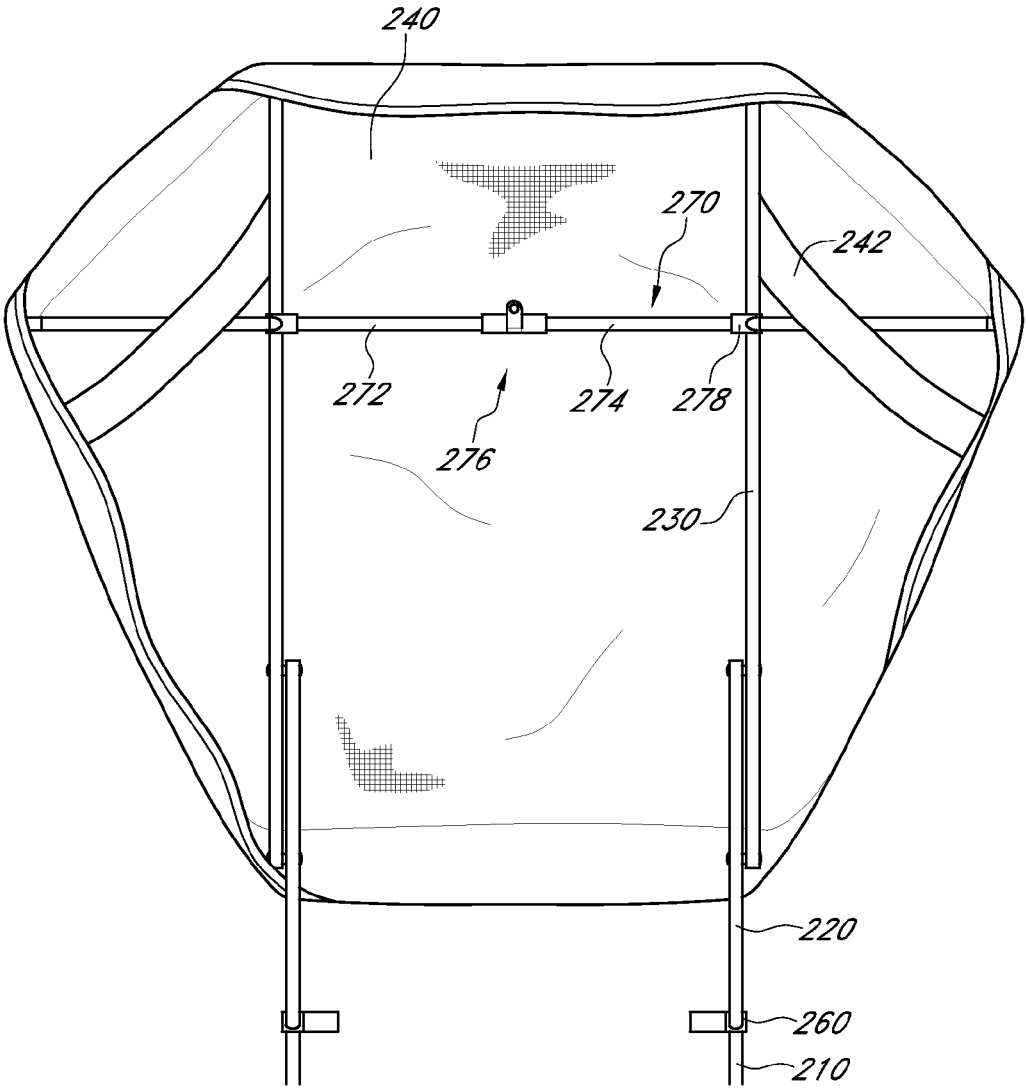
FIG. 3B illustrates a bottom view of the collapsible shade cover of FIG. 3A in an extended position.
Figure 3C:
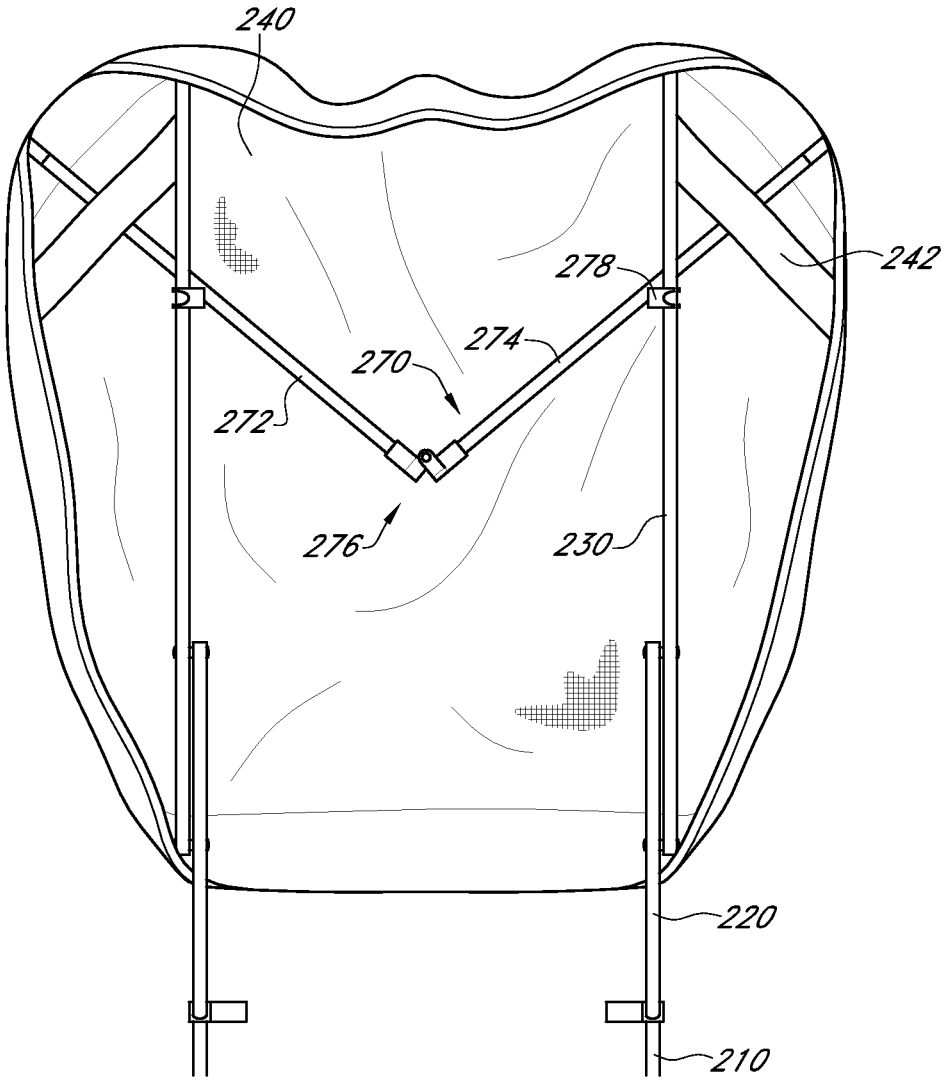
FIG. 3C illustrates a bottom view of the collapsible shade cover of FIG. 3A in a non-extended position.

FIG. 3A illustrates a top view of one embodiment of a collapsible shade cover 200 in an extended position. FIG. 3B illustrates a bottom view of the collapsible shade cover 200 of FIG. 3A in an extended position. FIG. 3C illustrates a bottom view of the collapsible shade cover 200 of FIG. 3A in a non-extended position. In one embodiment, as illustrated in FIGS. 3A-3D, the shade cover 240 may extend outwards of the cover extensions 230 on each side of the cover frame. Extending the shade cover 240 further out on each side increases the surface area of the shade cover 240, thus increasing the level of shade which the shade cover 240 can provide the user. In addition, the increased width of the shade cover 240 reduces the user's exposure to the sun and elements coming from each side of the collapsible chair with integrated collapsible shade cover. In one embodiment, the shade cover 240 provides between about 20% to about 60%, between about 30% to about 50%, between about 35% to about 45%, any value within these ranges, approximately 35%, or approximately 46%, more shade than a conventional cover or relative to the area defined between the cover extensions 230. As should be apparent, the amount of additional shade as compared to a conventional cover can be controlled based on the degree of outward extension of the cover from the cover extensions 230 and thus the amount of additional shade can be less than or greater than the ranges provided above.

In some embodiments, the cover extensions 230 extend generally or substantially in a fore-aft direction of the chair 100. The cover extensions 230 can be angled relative to a plane orthogonal to the plane of the shade cover 240. For example, in some configurations, the cover extensions can be angled either away from or towards the plane. This angle can be between about 0 degrees to about 10 degrees, from about 0 degrees to about 5 degrees, about 1 degree, about 2 degrees, about 3 degrees, and any other angle such as those within these ranges. In some configurations, the shade cover 240 extends outwardly of the cover extensions 230 between about 2 inches to about 12 inches, between about 4 to about 8 inches, any value within these ranges, about 6 inches, about 7 inches, or about 8 inches at a maximum point of extension beyond the cover extension 230. In some configurations, the shade cover 240 extends outwardly of the cover extensions 230 at a maximum point of extension beyond the cover extensions 230 between about 5% to about 50% of the length of the cover extensions 230, between about 15% to about 40% of the length of the cover extensions 230, between about 20% to about 30% of the length of the cover extensions 230, approximately 25% of the length of the cover extensions 230, or any other percentage such as those within these ranges. In some configurations, the shade cover 240 extends outwardly of the cover extensions 230 at a maximum point of extension beyond the cover extensions 230 about 50% to about 90%, between about 60% to about 80%, between about 65% to about 75%, about 70%, or any other percentage such as those within this range, of the distance between the maximum point of extension to the fore-most end of the cover extension 230. In some configurations, this can instead be the distance between the maximum point of extension to the aft-most end of the cover extension 230. The amount the shade cover 240 extends outwardly of the cover extensions 230 can be roughly the same on both sides of the shade cover 240 or can be different. In some embodiments, the shade cover can thus be asymmetric.

In one embodiment, as illustrated in FIG. 3B, the cover frame may further comprise a collapsible cross member 270. The cross member 270 comprises a first cross member leg 272, a second cross member leg 274, and a cross member coupling 276. In an extended position, the first cross member leg 272 and second cross member 274 leg are substantially parallel or collinear (co-axial) as well as substantially perpendicular to the cover extensions 230. The cross member 270 supports the portions of the cover which extend outwards of the cover extensions 230 on each side of the cover frame. Additionally, the cross member 270 also forces each side of the shade cover 240 outwards, keeping the shade cover taut across the cover frame. In some configurations, the cross member 270 extends outwardly of the cover extensions 230 between about 2 inches to about 12 inches, between about 4 to about 8 inches, any value within these ranges, about 6 inches, about 7 inches, or about 8 inches at a maximum point of extension beyond the cover extension 230. In some configurations, the cross member 270 extends outwardly of the cover extensions 230 at a maximum point of extension beyond the cover extensions 230 between about 5% to about 50% of the length of the cover extensions 230, between about 15% to about 40% of the length of the cover extensions 230, between about 20% to about 30% of the length of the cover extensions 230, approximately 25% of the length of the cover extensions 230, or any other percentage such as those within these ranges. In some configurations, the cross member 270 extends outwardly of the cover extensions 230 at a maximum point of extension beyond the cover extensions 230 about 50% to about 90%, between about 60% to about 80%, between about 65% to about 75%, about 70%, or any other percentage such as those within this range, of the distance between the maximum point of extension to the fore-most end of the cover extension 230. In some configurations, this can instead be the distance between the maximum point of extension to the aft-most end of the cover extension 230. The amount the cross member 270 extends outwardly of the cover extensions 230 can be roughly the same on both sides of the cross member 270 or can be different. In some embodiments, the shade cover can thus be asymmetric.

The cross member 270 may be located between the front portion and the rear portion of the cover extensions 230. In some embodiments, as illustrated in FIG. 3B, the cross member 270 is located closer to the front portion of each cover extension 230 than the rear portion of each cover extension 230 (e.g., about ¼ or ⅓ of the way from the front edge). In some embodiments, the cross member 270 may be located closer to the rear portion of each cover extension 230 than the front portion of each extension 230. The cross member 270 can be located at any position between the fore-most end and aft-most end of the cover extensions 230 and can be positioned at the fore-most or aft-most ends. In some embodiments, the shape of the shade cover 240 is adapted to suit the configuration and location of the cross member 270 relative to the cover extensions 230. The shade cover 240 generally comprises a top sheet which rests on top of the cover frame and may further comprise additional material hanging downward from the top sheet on at least one side of the shade cover 240. The additional material may serve several purposes. The additional material provides additional shade, and the additional material also helps retain the shade cover 240 on the cover frame. In one embodiment the additional material is constructed to be substantially perpendicular to the top sheet, and can slide over and surround the cover frame.

In one embodiment, each cross member leg 272, 274 is pivotally coupled to a cover extension 230, allowing each cross member leg 272, 274 to rotate from an approximately perpendicular position relative to the cover extension 230, to an approximately parallel position relative to the cover extension 230. In one embodiment, each cross member leg 272, 274 may be pivotally coupled to a cover extension 230 via a cross extension coupler 278. In one embodiment, the cross extension coupler 278 is affixed to a cover extension 230 and pivotally coupled to a cross member leg 272, 274. In one embodiment, the cross extension coupler 278 wraps around a cover extension 230. In one embodiment, a cover extension 230 may comprise a protrusion to help locate the cross extension coupler 278 along its length. In another embodiment, the cross extension coupler is affixed to a cross member leg and pivotally coupled to a cover extension (not illustrated). In one embodiment, the cross extension coupler may be configured to slideably engage a cover extension or a cross member leg (not illustrated).

In one embodiment, as illustrated in FIG. 3C, the cross member coupling 276 and cross extension couplers 278 allow the cross member 270 to bend at a location approximate its center to enter a non-extended position, allowing the collapsible shade cover 200 to collapse into a much smaller structure when the cross member 270 is in a non-extended position than when the cross member 270 is in an extended position, reducing or minimizing the size of the collapsible chair with integrated collapsible shade cover for storage and transport.

Figure 3D:
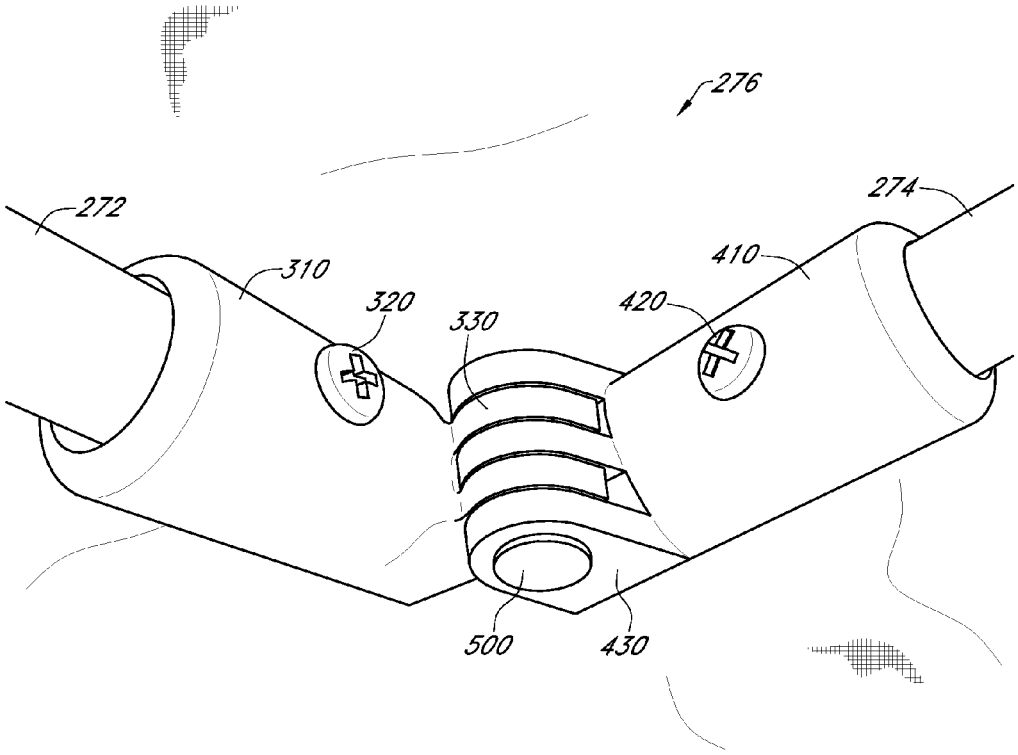
FIG. 3D illustrates a perspective view of one embodiment of a cross member coupling.

FIG. 3D illustrates a perspective view of one embodiment of a cross member coupling 276. In one embodiment, the cross member coupling 276 comprises a first receiver portion 310 and a second receiver portion 410. The cross member coupling 276 is configured to pivotally couple the first cross member leg 272 to the second cross member leg 274. The first receiver portion 310 comprises a sleeve constructed to receive one end of the first cross member leg 272. The first receiver portion 310 further comprises a hole formed therethrough to allow a first fastener 320 to pass through the first receiver portion 310 and retain the first cross member leg 272 to the first receiver portion 310. In one embodiment, a cross member leg may be retained in a receiver portion by other means, for example, via a friction, an interference fit, adhesives, or another type of mechanical fastening system.

In one embodiment, the first receiver portion 310 further comprises at least one hinge extension 330. Each hinge extension 330 comprises a substantially flat protrusion extending perpendicular from a side of the first receiver portion 310. Each hinge extension further comprises a hole formed therethrough to accept a hinge fastener 500. The second receiver portion 410 is similar to the first receiver portion however it is constructed to receive one end of the second cross member 274. In one embodiment, the cross member coupling 276 further comprises a hinge fastener 500 which passes through the holes formed therethrough each hinge extension 330, 430 of the first and second receiver portions 310, 410, pivotally coupling the first receiver portion 310 to the second receiver portion 410, and thusly the first cross member leg 272 to the second cross member leg 274. In one embodiment, the first receiver portion 310 and the second receiver portion 410 comprise a different number of hinge extensions 330, 430. In one embodiment, the first receiver portion 310 comprises three hinge extensions 330 while the second receiver portion 410 comprises two hinge extensions 430. In one embodiment, the first receiver portion comprises two hinge extensions while the second receiver portion comprises one hinge extension (not illustrated). In one embodiment, each receiver portion comprises one hinge extension (not illustrated). In some embodiment, more hinge extensions than those discussed above may be included.

In one embodiment, the cross member coupling 276 is constructed to prevent the first cross member leg 272 and the second cross member leg 274 from rotating substantially past a point at which the first cross member leg 272 and second cross member leg 274 are aligned (co-axial or parallel). In one embodiment, the cross member coupling 276 is constructed to allow the first cross member leg 272 and second cross member leg 274 to rotate just past the point at which the first cross member leg 272 and second cross member leg 274 are co-axial or parallel, helping the cross member 270 to lock into an extended position where the first cross member leg 272 and second cross member leg 274 are substantially co-axial or parallel. When the cross member 270 enters an extended position, the shade cover 240 is configured to be pulled taut, and thus exerts a force inwards on each end of the cross member 270. By constructing the cross member coupling 276 to prevent rotation of the cross member legs 272, 274 relative to one another substantially past the point that they are co-axial or parallel, the force provided by the shade cover 240 tends to lock the cross member 270 into an extended position, as illustrated in FIG. 3B.

In one embodiment, the shade cover 240 may incorporate sleeves or retaining straps 242 to secure the shade cover 240 to the cover frame. As illustrated in FIG. 3B, the cross member 270 may slide between the shade cover 240 and the retaining strap 242, securing the shade cover 240 to the cover frame. In one embodiment, the cross member 270 or a cover extension 230 may be secured to the shade cover 240 via mechanical means, adhesives, or for example a fastener.

In one embodiment, the cross member 270 increases the structural integrity and stiffness of the collapsible shade cover 200 and helps to maintain proper alignment of the collapsible shade cover 200 during windy conditions as well as during deployment and collapse of the collapsible shade cover 200, making deployment and collapse/smoother and easier.

Figure 4A:
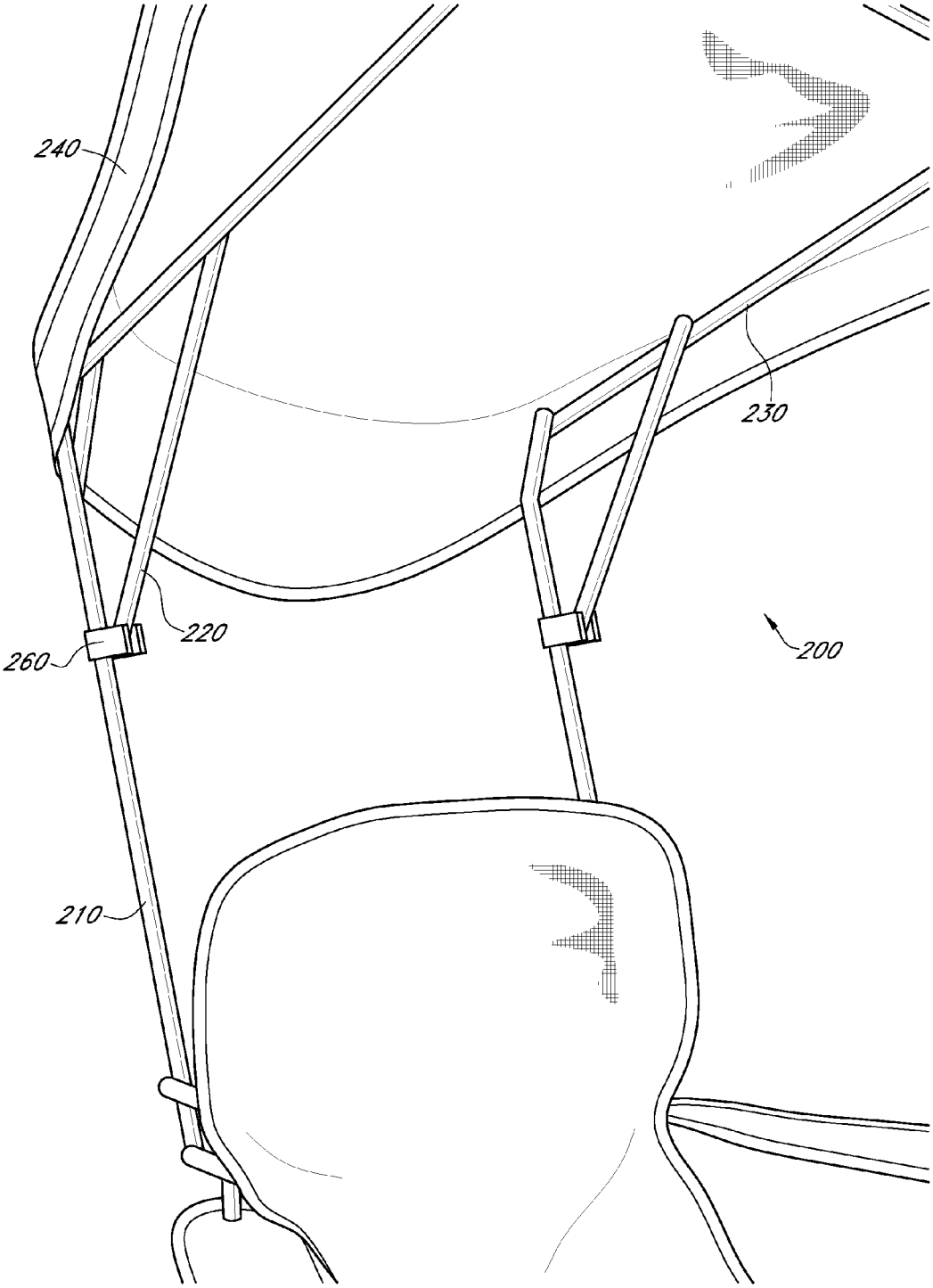
FIG. 4A illustrates a perspective view of one embodiment of a collapsible shade cover in a deployed state.
Figure 4B:
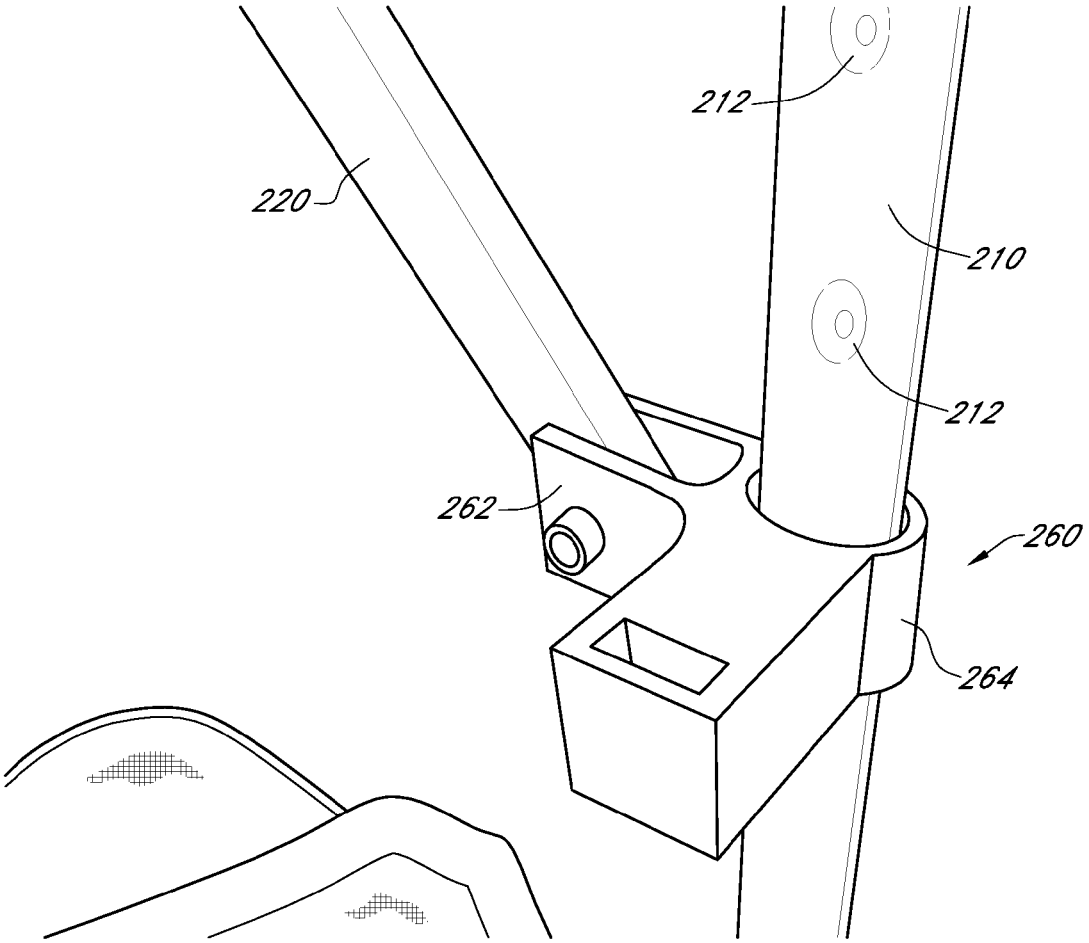
FIG. 4B illustrates a perspective view of one embodiment of a slide lock.

FIG. 4A illustrates a perspective view of one embodiment of a collapsible shade cover 200 in a deployed state. FIG. 4B illustrates a perspective view of one embodiment of a slide lock 260. In one embodiment, a slide lock 260 pivotally and slideably couples a cover support 220 to a cover leg 210. The slide lock 260 is constructed to lock the collapsible shade cover 200 in place at several increments along its range of motion. The slide lock 260 comprises a cover support engaging portion 262 and a cover leg engaging portion 264. The cover support engaging portion 262 pivotally couples the cover support 220 to the slide lock 260. In one embodiment, the cover support engaging portion 262 comprises a pair of protrusions with a hole formed therethrough, the hole being constructed to accept a fastener about which the cover support 220 can pivot. The cover leg engaging portion 264 comprises an aperture formed therethrough, the aperture being constructed to accept the cover leg 210 and allow the slide lock 260 to slide in a linear fashion along the cover leg 210. In one embodiment, the cover leg 210 comprises a plurality of detents 212 in the surface of the cover leg 210 along the length of the cover leg 210. In one embodiment the slide lock 260 comprises a detent engaging mechanism. In one embodiment, the detent engaging mechanism comprises a rod which is forced against the cover leg 210 by a biasing member. In one embodiment the biasing member could be a spring. In one embodiment the detent engaging mechanism can lock the slide lock 260 in position when it engages any one of the plurality of detents 212 along the cover leg 210. The user can overcome the locked position by forcing the slide lock 260 along the cover leg, which forces the rod and biasing means to retract into the slide lock 260, and allows the slide lock 260 to travel along the cover leg 210.

Figure 5A:
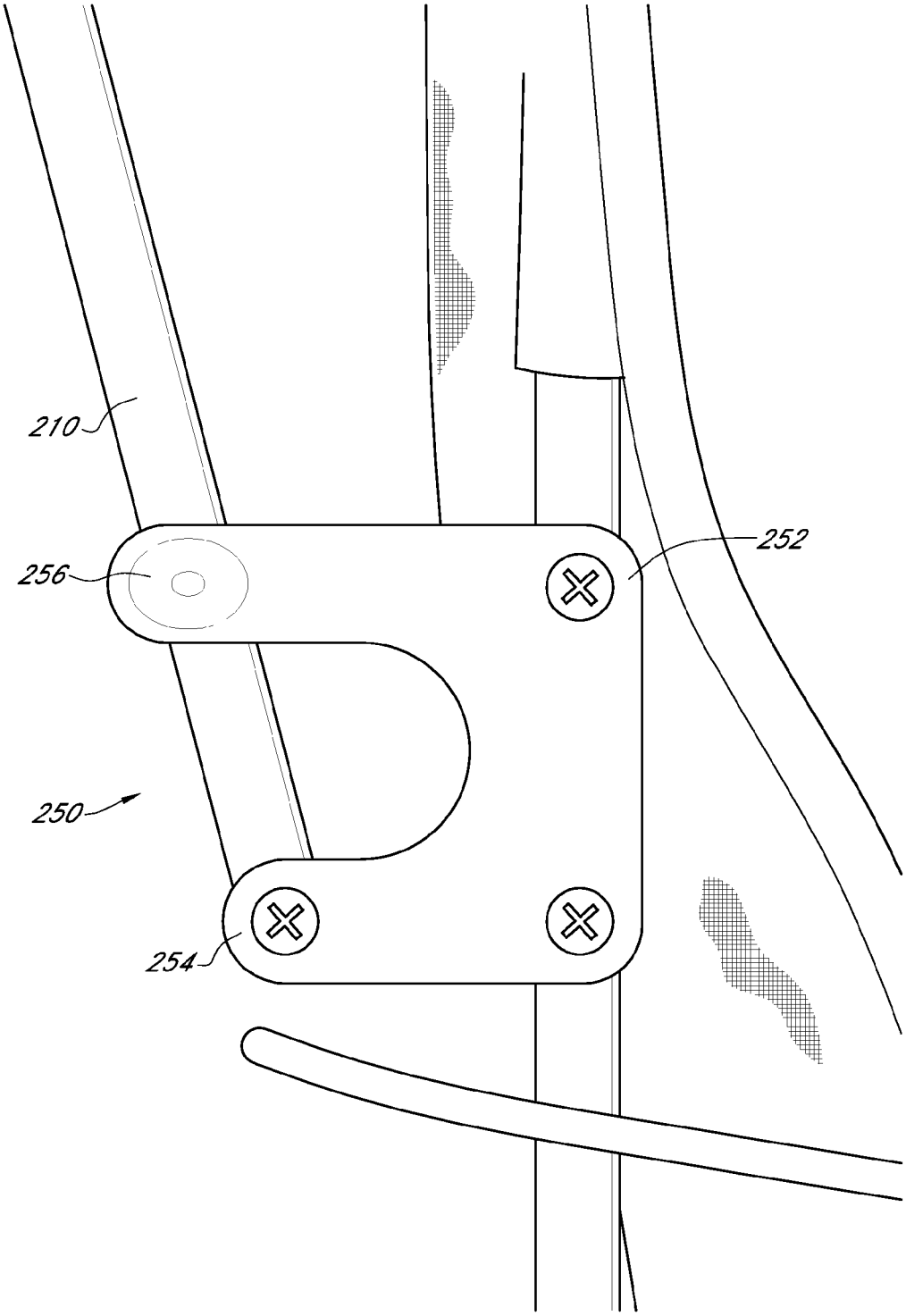
FIG. 5A illustrates a side view of one embodiment of a hinge lock in a locked state.
Figure 5B:
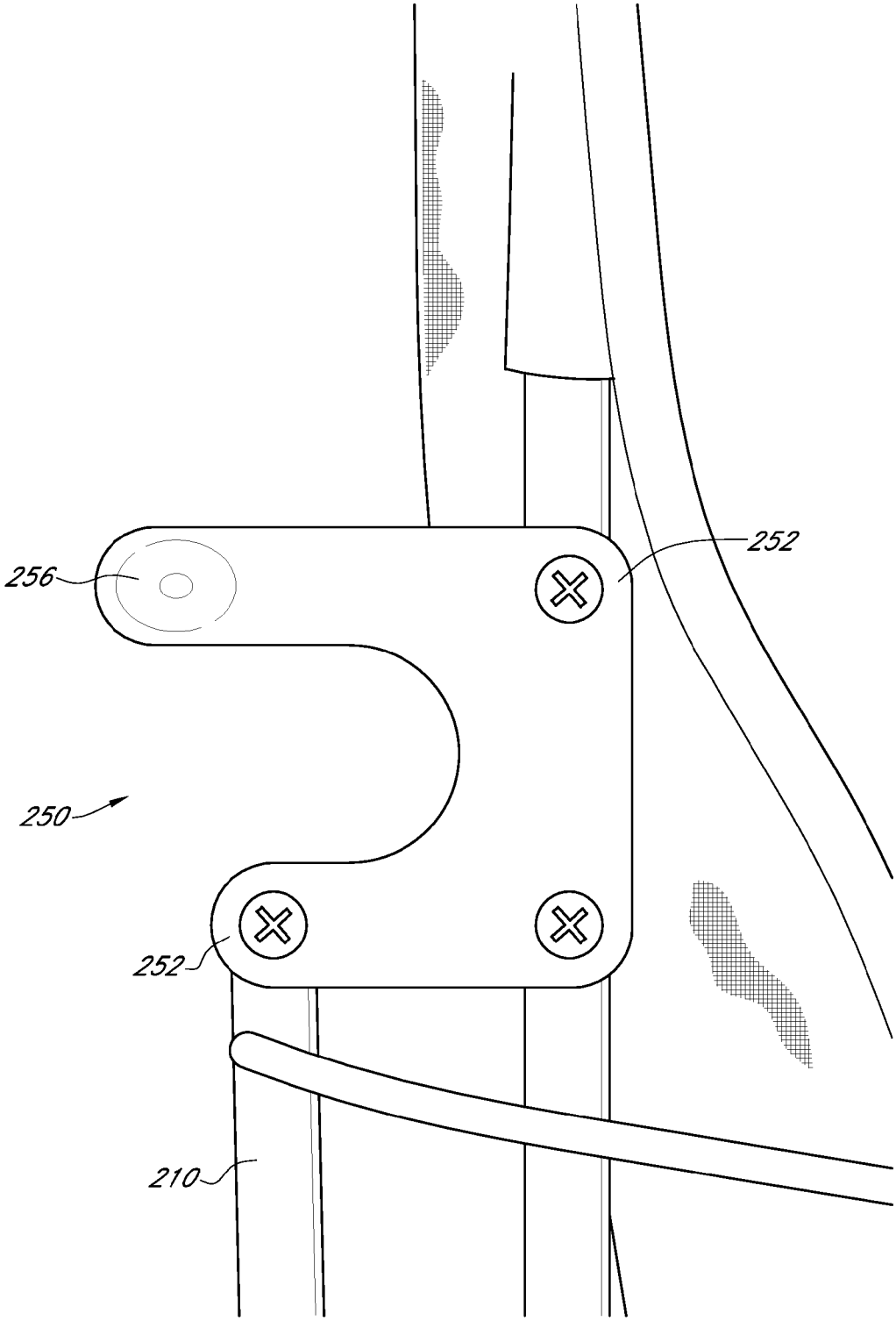
FIG. 5B illustrates a side view of the hinge lock of FIG. 5A in an unlocked state.
Figure 5C:
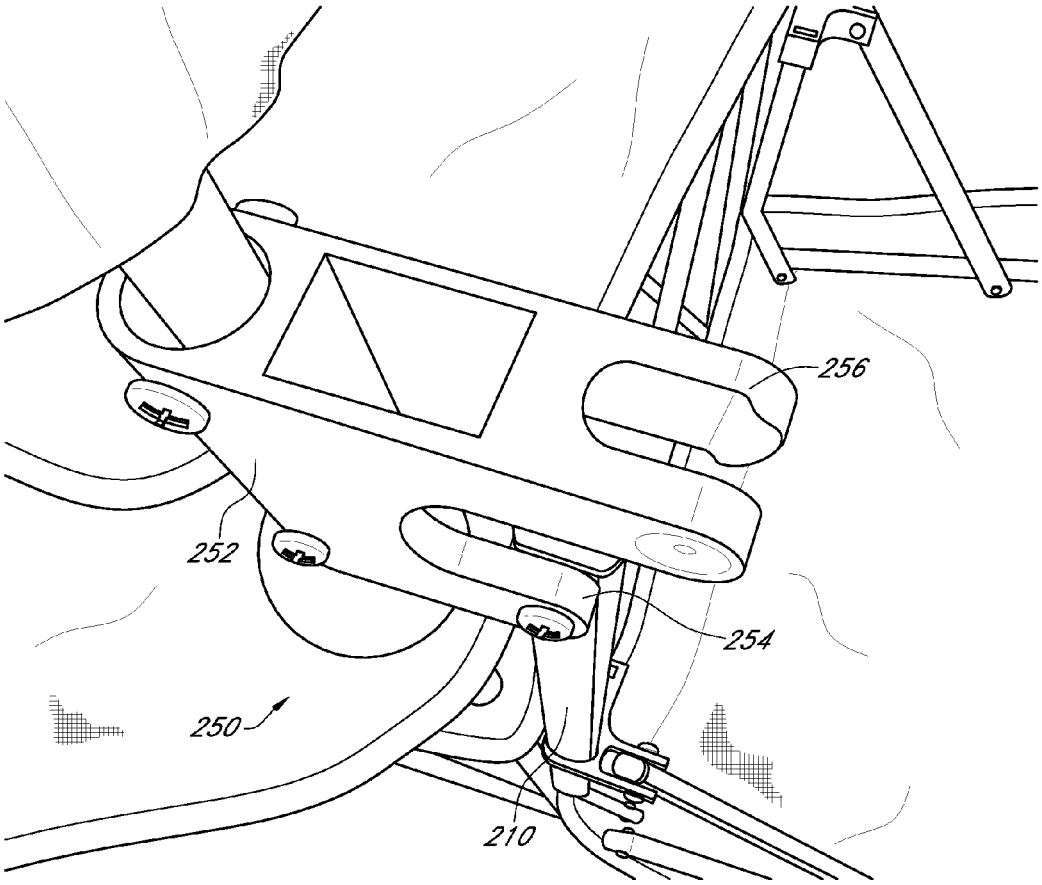
FIG. 5C illustrates a perspective view of the hinge lock of FIG. 5A in an unlocked state.

FIG. 5A illustrates a side view of one embodiment of a hinge lock 250 in a locked state. FIG. 5B illustrates a side view of the hinge lock 250 of FIG. 5A in an unlocked state. FIG. 5C illustrates a perspective view of the hinge lock 250 of FIG. 5A in an unlocked state. In one embodiment, as illustrated in FIG. 5A, the hinge lock 250 can lock the cover leg 210 in place, preventing the cover leg 210 from rotating relative to the collapsible chair 100 and keeping the collapsible shade cover 200 in a deployed state. As illustrated in FIG. 5B, the cover leg 210 can be released from the hinge lock 250 in order to collapse the collapsible shade cover 200. The hinge lock 250 comprises a hinge portion 254, a locking portion 256, and a vertical leg engaging portion 252. The vertical leg engaging portion 252 is affixed to the vertical leg 150 of the collapsible chair 100. In one embodiment, the vertical leg engaging portion 252 may be affixed to the vertical leg 150 via fasteners which pass through both the hinge lock 250 and the vertical leg 150. The hinge portion 254 pivotally couples the cover leg 210 to the hinge lock 250. In one embodiment, the hinge portion 254 comprises a pair of substantially flat protrusions with holes formed therethrough to accept a fastener about which the cover leg 210 may pivot. As illustrated in FIG. 5C, the locking portion 256 is constructed to engage the cover leg 210 and lock it in place. In one embodiment, the locking portion 256 comprises a pair of protrusions which are constructed to wrap around a portion of the cover leg 210. The protrusions are constructed to deflect when the cover leg 210 is forced into or out of the locking portion 256 during assembly or disassembly of the collapsible shade cover 200. Once the cover leg 210 is fully inside or outside the locking portion 256 of the hinge lock 250, the protrusions return toward or to their default orientation. When the cover leg 210 is inside the locking portion 260, the default orientation and the protrusions resistance to deflection retain the cover leg within the protrusions, and hold the collapsible shade cover 200 in a deployed position.

Figure 6:
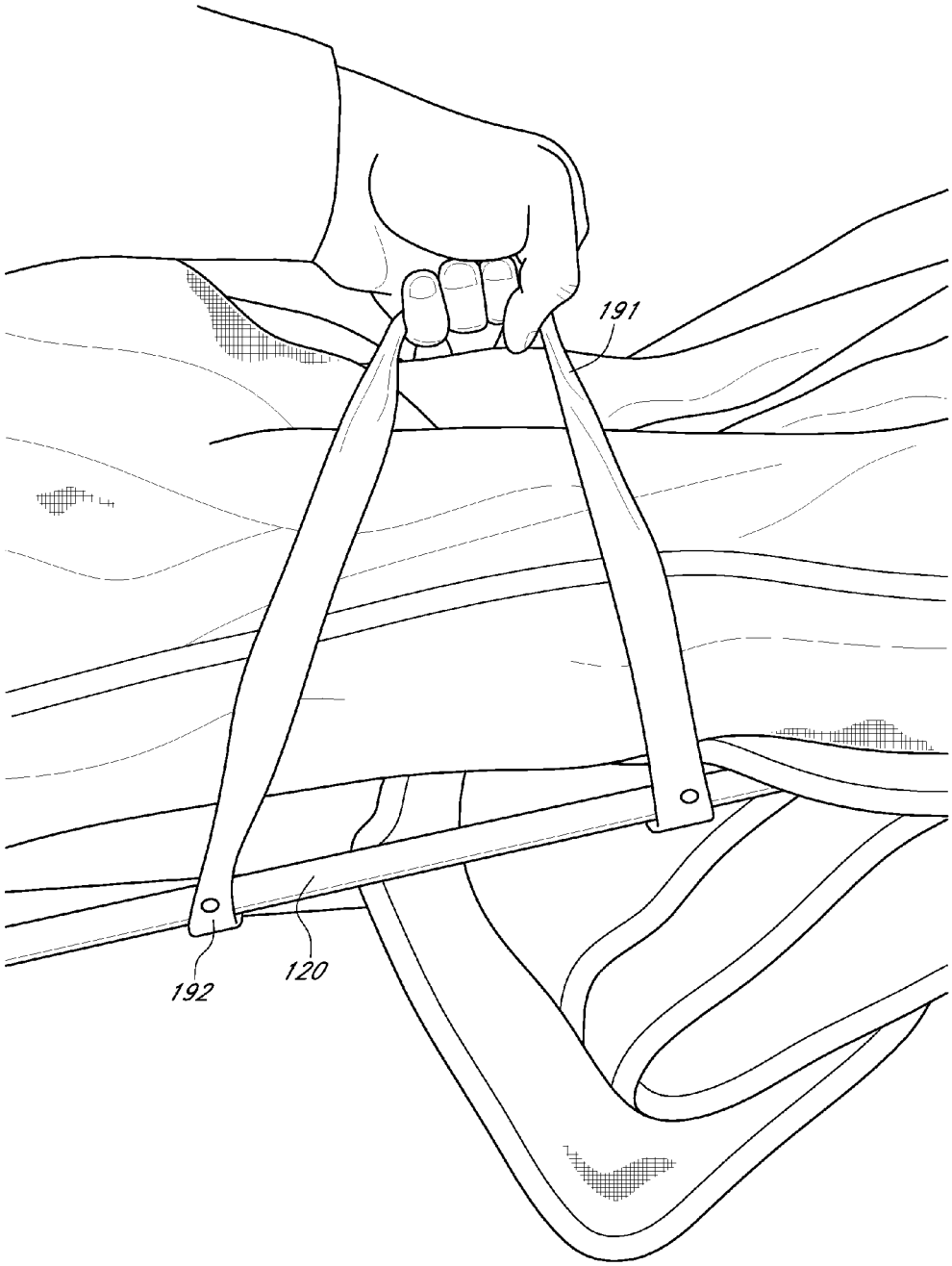
FIG. 6 illustrates a side view of a fully collapsed collapsible chair with integrated collapsible shade cover being carried by a user.

FIG. 6 illustrates a side view of a fully collapsed collapsible chair with integrated collapsible shade cover being carried by the user. In one embodiment, at least one handle 191 is affixed to a cross leg 110, 120, 130, 140 of the collapsible chair. In one embodiment, the handle 191 is attached to a cross leg 120, 130 on each side of the collapsible chair. In one embodiment, the handle 191 comprises a strap secured at each end to the cross leg 120. In one embodiment, the handle 191 is secured via a handle fastener 192. In one embodiment, as illustrated in FIG. 6, the handles are constructed to wrap around the collapsible chair and collapsible cover, retaining all of the frame members and fabric during transport.

In one embodiment, the seat 160, back rest 170, arm rest 180, and shade cover 240 are comprised of fabric or another material, canvas for example, which is flexible enough to deform when the collapsible chair with integrated collapsible shade cover is collapsed and preferably waterproof. In one embodiment, the chair frame legs 110, 120, 130, 140, 150, cover legs 210, cover supports 220, cover extensions 230, cross member 270, and any other collapsible chair with integrated collapsible shade cover frame member may comprise a metal tube. In one embodiment the metal tube may comprise an aluminum alloy. In one embodiment, the tube may be circular in cross section. In another embodiment, the tube may be, for example, ovular, square, or rectangular in cross section. In one embodiment the tube may not be metal but may be comprised of an alternative material, such as a plastic, a composite, or any other material of sufficient strength to support the structure and the user which sits in the collapsible chair with integrated collapsible shade cover. In one embodiment, the intermediary member 195, hinge lock 250, slide lock 260, cross member coupling 276, and cross extension coupler 278 may comprise a plastic material. In another embodiment, they may be constructed of an assortment of materials, for example, rubber, plastic, thermoplastic, thermoset, acrylonitrile butadiene styrene, polycarbonate alloy, acetal, acrylic, nylon, polybutylene terephthalate, polyester liquid crystal polymer, polypropylene, polycarbonate, polyimide, polyethylene, acetal homopolymer, ultra-high molecular weight polyethylene, steel, stainless steel, aluminum, titanium, or another metal material. In one embodiment, they may be formed in an injection molded process. In one embodiment, the material may be reinforced with glass or carbon fibers. In one embodiment, some of the elements may comprise one material while others comprise a different material.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims that follow.

What is claimed is:

1. A collapsible chair with integrated collapsible shade cover comprising:

a collapsible chair comprising a chair frame, a seat, and a back rest; and a collapsible shade cover configured to be coupled to said chair frame, said collapsible shade cover comprising:

a pair of cover legs configured to be pivotally coupled to said chair frame;

a pair of hinge locks configured to retain said pair of cover legs in a deployed position when said pair of hinge locks is in a locked position;

a pair of cover extensions configured to be pivotally coupled to said pair of cover legs;

a pair of cover supports configured to be pivotally coupled to said pair of cover extensions;

a pair of slide locks configured to be pivotally coupled to said pair of cover supports and slideably coupled to said pair of cover legs, wherein said slide locks are configured to lock in various positions along said pair of cover legs;

a shade cover configured to be affixed to said cover extensions;

a cross member comprising a first cross member leg and a second cross member leg, said cross member configured to be connected to said pair of cover extensions at a connection and having end portions configured to extend outwardly of said connection to said pair of cover extensions when in an extended state, said end portions of said cross member configured to support portions of said shade cover which extend outwardly and laterally of said cover extensions, wherein said cross member is configured to lock into said extended state and wherein said cross member is configured to collapse into a collapsed state for storage or transport.

2. The collapsible chair of claim 1, said cross member further comprising:

a cross member coupling configured to pivotally couple said first cross member leg to said second cross member leg, said cross member coupling comprising a first receiving portion configured to receive said first cross member leg, and a second receiving portion configured to receive said second cross member leg, wherein said second receiving portion is configured to be pivotally coupled to said first receiving portion, and wherein said cross member coupling is configured to prevent said first cross member leg and said second cross member leg from rotating substantially past a point at which said first cross member leg and said second cross member leg are aligned.

3. The collapsible chair of claim 1, wherein in said collapsed state, said first cross member leg and said second cross member leg are configured to be generally parallel to said pair of cover extensions.

4. The collapsible chair of claim 1, wherein said shade cover has an area which is between about 30% to about 50% more than an area defined between said cover extensions when said shade cover is expanded.

5. The collapsible chair of claim 1, wherein in said extended state, said end portions of said cross member are configured to extend outwardly of said connection between about 4 inches to about 8 inches.

6. The collapsible chair of claim 1, each of said pair of slide locks further comprising a detent engaging mechanism configured to engage detents of said pair of cover legs.

7. The collapsible chair of claim 1, wherein said connection is positioned between a front end and a rear end of each of said pair of cover extensions.

8. The collapsible chair of claim 7, wherein said connection is positioned between about ¼ to about ⅓ of the way from the front end of each of said pair of cover extensions.

9. A collapsible chair with integrated collapsible shade cover comprising:

a collapsible chair comprising a chair frame, a seat, and a back rest; and a collapsible shade cover configured to be coupled to said chair frame, said collapsible shade cover comprising:

a pair of vertical supports configured to be pivotally coupled to said chair frame;

a pair of cover extensions configured to be pivotally coupled to said pair of vertical supports and extend in a generally fore-aft direction of said chair;

a shade cover affixed to said cover extensions; and a cross member configured to be connected to said pair of cover extensions at a connection, said cross member having first and second end portions configured to extend outwardly of said connection to said pair of cover extensions when in an extended state, said first and second end portions configured to support portions of said shade cover which extend outwardly and laterally of said cover extensions, wherein said cross member is configured to collapse into a collapsed state.

10. The collapsible chair of claim 9, wherein in said collapsed state, said first and second end portions are configured to be generally parallel to said pair of cover extensions.

11. The collapsible chair of claim 9, wherein said shade cover has an area which is between about 30% to about 50% more than an area defined between said cover extensions when said shade cover is expanded.

12. The collapsible chair of claim 9, wherein in said extended state, said end portions of said cross member are configured to extend outwardly of said connection between about 4 inches to about 8 inches.

13. The collapsible chair of claim 9, wherein each of said cover extensions comprises a front end and a rear end, wherein said cross member when in an extended state is positioned between said front and rear ends of said cover extensions.

14. The collapsible chair of claim 9, wherein said connection is positioned between a front end and a rear end of each of said pair of cover extensions.

15. The collapsible chair of claim 14, wherein said connection is positioned between about ¼ to about ⅓ of the way from the front end of each of said pair of cover extensions.

* * * * *